United States Patent [19]

Patel

[11] Patent Number: 4,667,490

[45] Date of Patent: May 26, 1987

[54] MOLDABLE WARP KNITTED FABRIC

[75] Inventor: Shantilal G. Patel, Clifton, N.J.

[73] Assignee: International Playtex, Inc., Stamford, Conn.

[21] Appl. No.: 816,030

[22] Filed: Jan. 3, 1986

[51] Int. Cl.[4] ..... D04B 21/00

[52] U.S. Cl. ..... 66/195; 66/202

[58] Field of Search ..... 66/195, 202

[56] References Cited

U.S. PATENT DOCUMENTS

| | | | |
|---|---|---|---|
| 3,981,310 | 9/1976 | Donaghy | 66/195 |
| 4,015,451 | 4/1977 | Gajjar | 66/195 |
| 4,307,587 | 12/1981 | Baesgen et al. | 66/195 |

OTHER PUBLICATIONS

Reisfeld, A., "Knitted Outerwear Times", vol. 38, No. 8, Feb. 24, 1969.

"Warp Knit Fabrics and Products", Part 6, pp. 35–47.

*Primary Examiner*—Ronald Feldbaum

*Attorney, Agent, or Firm*—Stewart J. Fried; Charles N. J. Ruggiero

[57] ABSTRACT

A moldable, fabric is provided which is adapted to be used in conjunction as a molded, brassiere cup. The fabric is warp knitted on a two bar warp knitting machine and includes front and back guide bar yarns which are knitted in opposite directions relative to each other in at least a two course knitting operation. At least one of the yarns is a monofilament yarn. The front guide bar yarn is a multifilament yarn and the back guide bar yarn is a monofilament yarn with the back guide bar yarn having a knit stitch configuration of 2/0-$\frac{1}{3}$ and the front guide bar yarn having a knit stitch configuration of $\frac{3}{4}$-1/0.

4 Claims, 4 Drawing Figures

TWO REPEATS

FIG. IA
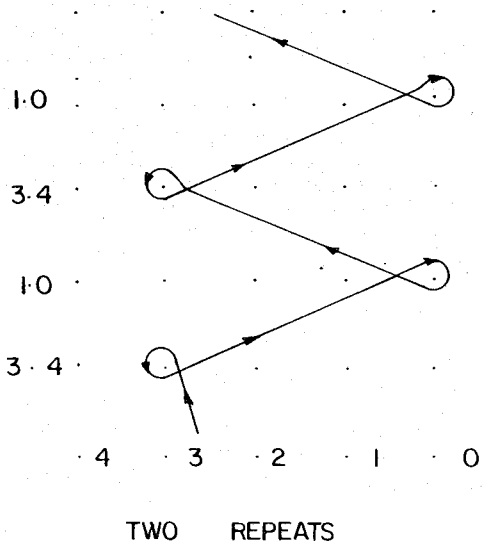
FIG. IB
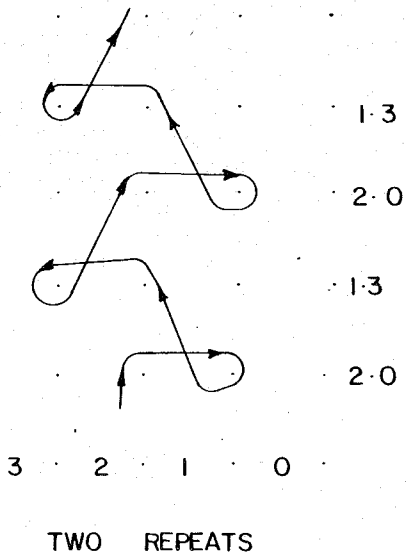

MOLDABLE WARP KNITTED FABRIC

BACKGROUND OF THE INVENTION

1. Field of the Invention

The present invention relates to a warp knitted fabric having application with respect to brassieres and, more particularly, to a warp knitted fabric used for brassiere cups which fabric has optimum stability and recovery.

Multi-section sewn brassiere cups in recent years have been replaced by molded brassiere cups. Such molded brassiere cups typically utilize knitted fabrics of continuous filament yarns. In recent years, there has been a gradual evolution with respect to the types of fabrics, and characteristics of same, best suited for such an application. The fabric chosen must, however, have a soft hand after molding, be sufficiently stable, and maintain its shape even after repeated machine launderings.

2. Description of the Prior Art

Brassiere cups have evolved from the sewing together of a number of pieces of fabric, such as cotton, to form a three-dimensional brassiere cup to the molded three-dimensional brassiere cup which is quite common today. Although sewn brassiere cups generally provide satisfactory performance, the ridge or seam lines inherent in such garments oftentimes are aesthetically undesirable to many wearers particularly under sheer garments. As such, there has been a trend in recent years to such molded, "seamless" cups.

Early efforts at producing molded cups involved the use of molded nylon fabrics. The use of such warp knit fabrics made with textured nylon yarns is described, for example, in *Textured Yarn Technology* Vol. 1, (Monsanto, 1967) at pages 374–381. See also, Merrill G. R., *Cotton Ring Spinning,* Mass. (Merrill, 1959) at pages 88,90; and Reisfeld, A., *Warp Knit Engineering,* (New York National Knitted Outerwear Association, 1966) at 50–61, 76–83, 462–3.

Because of the polymeric structure of nylon which does not lend itself to shape retention, subsequent developmental efforts concentrated, instead, on polyester yarns. Problems however, were encountered in molding uniform brassiere cups with woven polyester constructions and, as such, the developmental efforts switched to knitted rather than woven polyester constructions. Initially, multifilament polyester yarns were used followed by monofilament polyester yarns. Although monofilament yarns provided a more stable fabric, they are coarse or have a rough hand. Accordingly, efforts have been made to correct such problems by the stitch construction of the fabrics.

U.S. Pat. No. 3,981,310, which issued on Sept. 21, 1976 to James G. Donaghy, and is owned by the assignee of the present application, describes a particularly advantageous warp knit fabric construction which uses continuous and monofilament polyester yarns. The Donaghy patent provides three bar, warp knit fabric which includes a top or front, middle, and a bottom or back guide bar yarns. The front bar includes multifilament yarns including polyester. The middle and back bars include monofilament polyester yarns. The front bar may be in a $\frac{2}{3}$–1/0 or a $\frac{3}{4}$–1/0 stitch configuration. The middle and back bars preferably are in a 1/0–$\frac{1}{2}$ and a $\frac{1}{2}$–1/0 stitch configuration, respectively. Such constructions constituted a substantial improvement over the prior art attempts in that the resultant molded fabric was capable of being molded and retained its shape and support after a number of launderings.

The Donaghy patent relies on a three bar, warp knit machine which is relatively expensive to run. The ability to achieve a hand similar to the warp knit fabric of Donaghy with a two bar machine would provide a distinct commercial cost advantage in the marketplace. Attempts at producing such a fabric on a two bar machine have, to date, still failed to achieve the hand, stability and recovery characteristics heretofore possible only with a warp knit fabric produced on a three bar machine.

The use of one or two bar warp knit machines is not new, although, fabrics knit with such machines have generally lacked the requisite hand, stability and recovery characteristics required for use in a molded brassiere cup. See, for example, U.S. Pat. No. 4,015,451, which issued on Apr. 5, 1977 to B. J. Gajjar, and which describes a number of different loop patterns which may be formed on a two bar machine.

An alternative version of a two way stretch warp knit fabric formed on a two bar machine is discussed in U.S. Pat. No. 4,064,712 which issued on Dec. 27, 1977 to J. F. Sayre et al. The front bar in Sayre et al. includes a two needle overlap progression for each loop. A 2/0–2/4 front bar pattern and an alternative 2/4–3/-1–4/2–0/2 front bar patterns are both discussed.

Other examples of two bar warp knit machines include U.S. Pat. Nos. 3,027,738 which issued on Apr. 3, 1962 to W. Turton and 1,666,638 which issued on Apr. 17, 1928 to E. J. Bennett; and German Pat. No. 649,553 which issued on Aug. 30, 1937. See also, U.S. Pat. No. 4,502,302, which issued on Mar. 5, 1985 to Y. Matsuda.

Examples of warp knitting on a single bar machine include, for example, French Pat. No. 2419-990, which issued on Nov. 16, 1979, and which shows in examples 4, 5 and 7 (FIGS. 7–12) a stitch pattern of 2/0–$\frac{1}{3}$ which is formed on a single bar machine. See, also U.S. Pat. No. 4,307,587, which issued on Dec. 29, 1981 to H. Baesgen, et al., and which discusses a single bar warp knit pattern wherein the loop extends at least over three stitches. Three stick versions of the 2/0–$\frac{1}{3}$ pattern are shown in FIGS. 4 and 5.

However, the fabrics produced on such one and two bar machines lack the hand, stability and recovery characteristics required for forming a molded brassiere cup.

SUMMARY OF THE INVENTION

It is an object of the present invention to provide an economical moldable warp knit fabric suitable for brassiere breast cups.

It is another object of the present invention to provide a moldable warp knit fabric having comfortable hand and excellent durability.

It is a further object of the present invention to provide such a fabric having optimum stability and recovery.

It is still a further object of the present invention to provide such a fabric which is formed from a monofilament yarn and a multifilament yarn.

It is yet a further object of the present invention to provide such a molded warp knit fabric which is knit on a two bar warp knit machine.

It is still yet a further object of the present invention to provide such a fabric in which the front bar yarn is knit in an opposite direction from the back bar yarn.

It is yet still another object of the present invention to provide such a fabric in which the front bar yarn is a multifilament yarn and the back bar yarn is a monofilament yarn which are knit in a two course knitting construction.

It is yet another object of the present invention to provide such a fabric in which the front bar yarn is a multifilament yarn and has a knitting configuration of $\frac{3}{4}$-1/0.

It is still yet another object of the present invention to provide such a fabric in which the back bar yarn is knitted in closed stitches on two needle overlaps for each course in a 2/0-$\frac{1}{3}$ stitch construction.

These and further objects of the present invention are provided by the preferred embodiments thereof described hereinafter.

BRIEF DESCRIPTION OF THE DRAWINGS

FIGS. 1A and 1B diagramatically illustrate the stitch configuration of the front and back bars, respectively, of the fabric construction of the present invention.

DESCRIPTION OF THE PREFERRED EMBODIMENTS

Figure 2B:
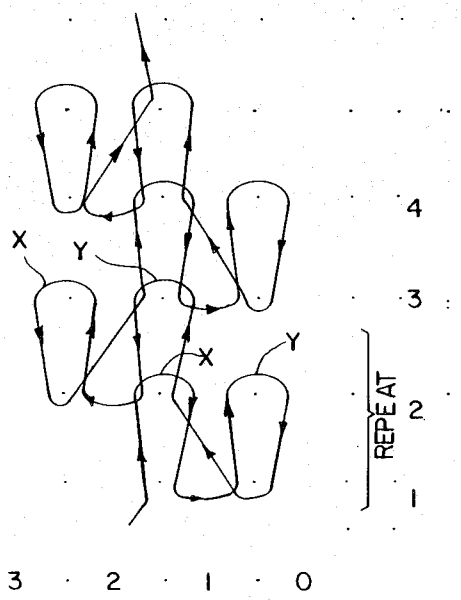
FIGS. 2A and 2B diagramatically illustrate knit stitch loop diagram.

The fabric of the present invention is particularly applicable for use in a molded brassiere cup as well as in other garment applications, such as, for example, other articles of intimate apparel and the like. For the fabrics used in intimate apparel items, the stitch configuration of the fabric, to a large measure, controls its ultimate physical characteristics. When used in an article such as, for example, a molded brassiere cup, the fabric must be able to stretch to permit it to conform to a three-dimensional mold as well as be sufficiently stable and recoverable to be able to withstand repeated wearings and launderings. Stability is basically providing proper level of support, while recovery is basically the ability of the failure to take the predesignated final form, i.e. stitching the fabric beyond the predesignated final form so that it collapses or recovers to the predetermined final form.

The stitch configuration of a preferred fabric construction is diagrammatically illustrated in FIGS. 1A and 1B with FIG. 1A representing the stitch configuration for the front guide bar and FIG. 1B representing the fabric configuration for the back guide bar. The fabric is intended to be run on a two guide bar warp knitting machine of conventional design, preferably a 28 or a 32 (needle per inch) gauge machine.

With respect to the actual knitting operation, the front and back guide bars of the warp knitting machine are run in opposition to each other. As illustrated in FIGS. 1A and 1B, the stitch configuration for the front guide bar is $\frac{3}{4}$-1/0 and the stitch configuration for the back guide bar is 2/0-$\frac{1}{3}$. Alternatively, the front guide bar stitch configuration may be $\frac{2}{3}$-1/0 while the back guide bar stitch configuration remains the same. For a thorough understanding of such number notation system, reference should be made to the aforementioned U.S. Pat. No. 3,981,310 to James G. Donaghy the disclosure of which is hereby incorporated herein by reference.

It should be noted that a knitting machine manufacturer starts with the 0 on the pattern wheel scale of the machine so that zero as viewed in FIGS. of this application should be on right. However, if viewed on left it is mirror image as shown in the Donaghy patent and the stitch configuration numerals should also be inverted, for example $\frac{3}{4}$-1/0 becomes 1/0-$\frac{3}{4}$.

In such a stitch configuration, the back guide bar knitting a two needle overlap for two courses although they are knitting in the opposite direction as the front bar with such a 2/0-$\frac{1}{3}$ configuration. The front guide bar knitting has a configuration of $\frac{3}{4}$-1/0 for the two courses in a direction opposite to the direction of the back bar, but not a two needle overlap.

It has been found that a preferred yarn for knitting on the front guide bar is a multifilament yarn, such as a polyester, nylon or co-spun polyester/nylon yarns.

A preferred yarn for knitting on the back guide bar is a monofilament yarn, such as a monofilament polyester yarn. In a particularly preferred embodiment, the monofilament yarn used is a 20/1 monofilament polyester yarn. An example of such monofilament yarn is produced by Hanover.

It has been found that the back guide bar provides the requisite stability and recovery using two needle overlap stitch, while the front guide bar provides coverage. The resultant fabric produced using such yarns and with such a knit configuration has a soft hand and a degree of stability, as well as recovery, heretofore only associated with fabrics knitted on a three bar knitting machine.

Figure 2A:
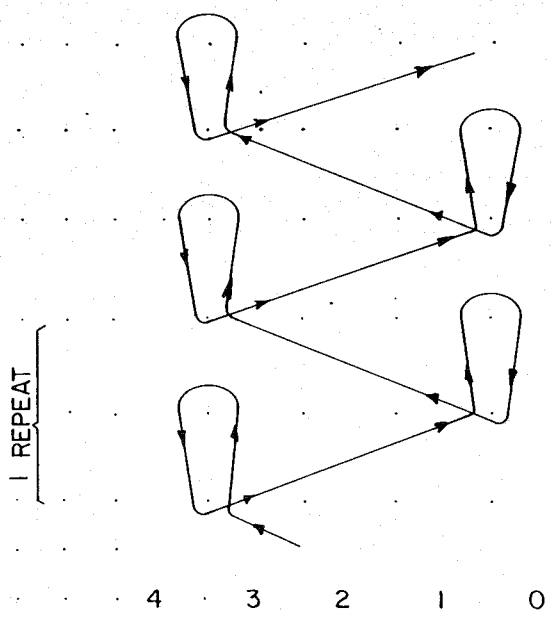

FIGS. 2A and 2B illustrate the knit stitch loop diagram of the front guide bar and back guide bar, respectively. As shown in FIG. 2B, the back guide bar has two loops X and Y in each course, therefore it is called a two needle overlap.

Although certain embodiments have been described and illustrated, modification may be made as by substituting equivalents while retaining the advantages and benefits of the present invention which is defined in the following claims.

I claim:

1. A moldable, fabric warp knitted on a two bar warp knitting machine, said fabric including front and back guide bar yarns knitted in opposite directions to each other in at least a two course knitting construction, wherein said front guide bar yarn is a multifilament yarn, and wherein said back guide bar yarn is a monofilament yarn knit having a knit stitch configuration of 2/0-$\frac{1}{3}$ which is knitted with a two needle overlap on both courses.

2. The fabric construction of claim 1, wherein said monofilament yarn is a 20/1 monofilament polyester yarn.

3. The fabric construction of claim 1, wherein said front guide bar yarn has a knit stitch configuration of $\frac{3}{4}$-1/0.

4. A moldable, three-dimensional brassiere cup comprising a warp knit fabric which is knitted on a two bar warp knitting machine, said fabric includes front and back guide bar yarns knitted in opposite directions in a two course knitting construction, said front guide bar yarn constituting a multifilament yarn and said back guide bar yarn constituting a monofilament yarn, wherein said front guide bar yarn has a stitch configuration of $\frac{3}{4}$-1/0, and wherein said back guide bar yarn has a stitch configuration of 2/0-$\frac{1}{3}$ and is knitted with a two needle overlap on both courses.

* * * * *